United States Patent [19]

McMorrow

[11] 4,293,796

[45] Oct. 6, 1981

[54] TRAFFIC LIGHT DIMMING TECHNIQUE AND CIRCUITRY

[76] Inventor: Clyde H. McMorrow, 1701 Fortune Dr., San Jose, Calif. 95131

[21] Appl. No.: 110,140

[22] Filed: Jan. 7, 1980

[51] Int. Cl.[3] ..... H05B 37/02; H05B 39/06

[52] U.S. Cl. ..... 315/205; 307/252 B; 307/41; 315/159; 315/199; 315/208; 315/317

[58] Field of Search ..... 315/156, 159, 194, 199, 315/200 R, 201, 205, 208, 291, 317, 318, DIG. 4; 307/252 B, 252 N, 252 P, 252 VA, 41

[56] References Cited

U.S. PATENT DOCUMENTS 3,500,456 3/1970 Ross ..... 315/194 X 4,160,192 7/1979 McAllise ..... 315/194

*Primary Examiner*—Eugene R. La Roche

*Attorney, Agent, or Firm*—Limbach, Limbach & Sutton

[57] ABSTRACT

A traffic light control circuit of the type utilizing solid state thyristor switches with their control terminals driven by a diode bridge trigger network that includes switches for selectively interrupting one or both legs of the trigger network for energizing the traffic lights with either full wave power for normal daytime operation or half-wave power for night time operation at reduced brightness, thereby providing power savings for night time operation.

2 Claims, 6 Drawing Figures

TRAFFIC LIGHT DIMMING TECHNIQUE AND CIRCUITRY

BACKGROUND OF THE INVENTION

This invention relates generally to dimming control systems for lamps, specifically incandescent lamps, and, more particularly, to a dimming control system for traffic control signal lamps.

In recent years, there has been a great deal of effort directed towards developing lighting systems that use less electrical power. A significant amount of energy is wasted by present commercial traffic control lighting systems that are operated at a single power level. The high light output required for visibility during sunrise, sunset and daylight operation greatly exceeds that which is required for visibility during the night hours. Present commercial approaches to conserving traffic light energy by dimming the lamps during hours of darkness have approached the problem by utilizing a chopper network or high current silicon controlled rectifiers in the power path to the lamps. These approaches have certain disadvantages in that the chopper network generates undesirable noise and the silicon controlled rectifier systems are of a high cost and erratic operation.

Therefore, it is a principal object of the present invention to provide a light dimming circuit particularly applicable to traffic lights that overcome these disadvantages and does so in an economical, reliable and flexible manner.

SUMMARY OF THE INVENTION

This and other objects are accomplished by the present invention wherein, briefly, the dimming capability of an incandescent light controller of the type utilized with traffic lights is provided in the low current control circuitry rather than in the high current power supply path to the lamps themselves. A three terminal switching device, such as a thyristor, as presently provided in the path of lamps for switching them on or off, are selectively driven at their control terminals, according to the present invention, in either a manner to be continuously conductive for driving the lamp with full wave current or becoming conductive during only positive or negative half cycles of such current to drive the lamp with half-wave current. The full wave operation drives the lamp at full brightness for daytime operation and half-wave current drives the lamp at reduced brightness, operated at approximately 60% of rated power.

According to another aspect of the present invention, such operation is provided by altering a standard control circuit of a thyristor driven by a diode bridge trigger network connected to its control terminal. One or both legs of the bridge network are provided with controllable switches for opening those bridge leg circuits. When only one bridge leg is conductive, the control terminal of the thyristor is triggered to conduct during only positive or negative half cycles of the power supply, depending upon which network leg is open. This permits balancing the load of the traffic signal installation so that the lamps operating in the dim state appear to the power source as if approximately half the load was disconnected. When both bridge trigger network legs are conductive, the thyristor is triggered each half cycle of the alternating current source and thus applies full wave power to its associated light.

Other objects, advantages and aspects of the present invention will become apparent from the following detailed description of its preferred embodiments, which should be taken in conjunction with the accompanying drawings.

DESCRIPTION OF THE PREFERRED EMBODIMENT

Figure 1:
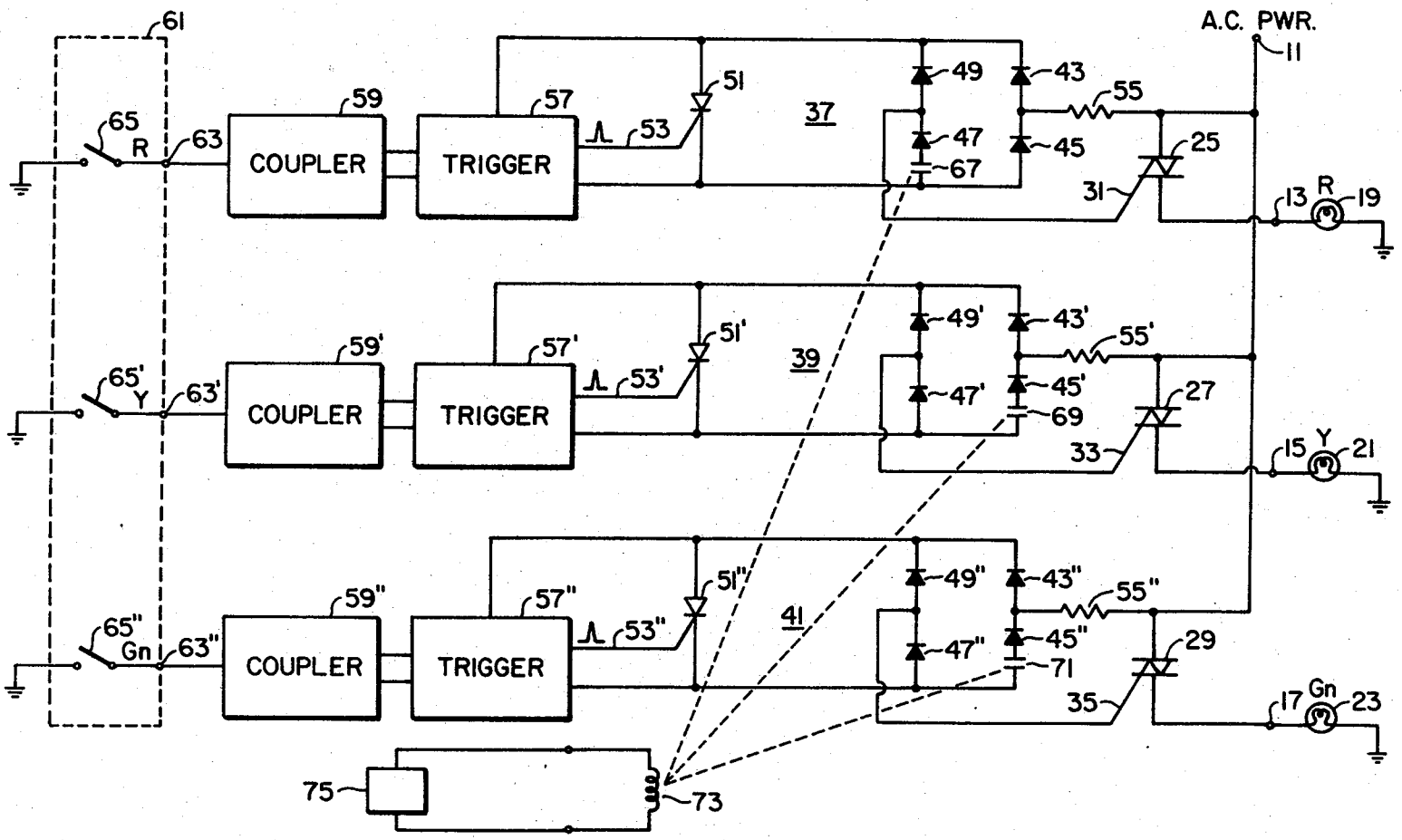
FIG. 1 illustrates a traffic light control circuit that utilizes one specific form of the dimming technique of the present invention.

Referring to FIG. 1, a circuit implementation of the present invention is shown for driving one traffic light head that includes one red, one yellow and one green traffic light. The purpose of the circuit of FIG. 1 is to selectively connect to an ungrounded AC power terminal 11 one of the terminals 13, 15 or 17 to which a red light 19, a yellow light 21 and a green light 23 may be respectively connected at one terminal of the lamps. The other lamp terminals are grounded to complete the circuit. The type of lamps 19, 21 and 23 for which the circuit is designed to operate are incandescent lamps. Each of the terminals 13, 15 and 17 are controllably energized through respective switching devices 25, 27 and 29 that are connected between these terminals and the AC power terminal 11. The switching devices 25, 27 and 29 can be selected from a wide variety of mechanical or semi-conductor switching devices. Each of these devices is a thyristor in the particular circuit of FIG. 1, having individual control terminals 31, 33 and 35, respectively. The thyristor is characterized by becoming conductive when gated at its control terminal until the current through the device between its main two terminals crosses zero, at which time the thyristor becomes non-conductive and must be gated again in order to become conductive.

Each of the thyristor control terminals are driven by individual diode bridge trigger networks 37, 39 and 41. The bridge networks have the same basic circuit which is of a type used in prior art traffic signal controllers for driving a control terminal of a thyristor. Referring to diode network 37 as an example, a pair of diodes 43 and 45 are connected in series with a polarity that allows current to flow in a given direction. This series network is connected in parallel with another series network of two diodes 47 and 49 which are connected together with similar relative polarities. A silicon controlled rectifier (SCR) 51 is similarly connected in parallel with the two diode circuits but with a polarity that allows current to pass in an opposite direction to that of the diodes when the SCR 51 is made conductive upon applying a proper signal to its gate terminal 53. AC power is connected to the diode circuit by a resistor 55 connected between the AC power input terminal 11 and the junction between the diodes 43 and 45. The control terminal 31 of the thyristor 25 is connected to the junction between the diodes 47 and 49.

The controlling signal for the gate 53 is generated by a trigger circuit 57 which is supplied with power from the AC terminal 11 through the diode network 37. The trigger circuit 57 is, in turn, controlled by a signal from an optical coupler 59 that is utilized to isolate the circuit from input control circuit 61 to which it can be connected. The control circuit 61 emits appropriate signals when the traffic lights of the circuit of FIG. 1 are to be lighted and is usually part of a larger control system for an entire intersection installation. In simplified terms, the controller 61 couples to the terminal 63 of the FIG. 1 circuit a switch 65 that is closed to ground the terminal 63 when it is desired to illuminate the red traffic light 19.

Each of the diode bridge trigger networks 39 and 41 are constructed similar to that of the network 37. Corresponding components of the network 39 are identified with the same reference numbers but with a prime (') added. Similarly, the network 41 utilizes the same reference numbers for corresponding components with a double prime (") added. The circuits differ, however, in the placement of control switching devices. The network 37 contains a switching device 67 that is operable between conductive and nonconductive states in series with the diode 47. This switch is shown in this embodiment to be a pair of relay contacts but could also be a semi-conductor switching device. A similar switching device 69 is placed in the network 39 in series with the diode 45' in a different diode leg than with the network 37. The network 41 has a similar switching device 71 placed in series with its diode 45", similar to the network 39. The switching devices 67, 69 and 71 are controlled by a common relay coil 73 to either all be conductive or nonconductive at the same time. These circuit elements constitute the lamp dimming control. The relay coil 73 is driven by a control circuit 75 which could include, for example, a timer or a photosensitive switch. The switches 67, 69 and 71 are caused to be closed (or conductive) during daylight hours in order to operate the lamps 19, 21 and 23 at full power. During hours of darkness, however, the switches 67, 69 and 71 are all opened to thereby operate their respective lamps at reduced brightness and thus reduce power consumption.

Figure 2:
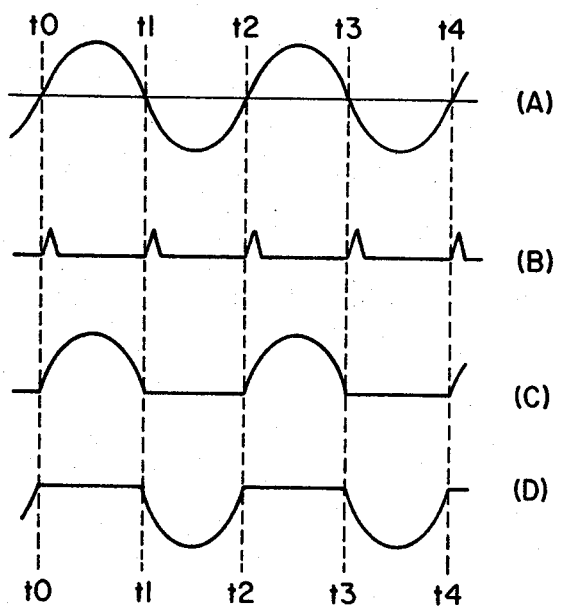
FIGS. 2A, 2B, 2C and 2D show typical wave forms at various positions in the circuit of FIG. 1.

Referring to FIG. 2, the dimming operation of the circuit of FIG. 1 will be explained. For a reference, the AC power waveform at the terminal 11 is shown as FIG. 2A. The trigger circuits 57, 57' and 57" emit a spiked pulse at each instant t0, t1, etc. when the voltage waveform at the terminal 11 of FIG. 2A crosses zero. A spike is emitted at such instance, however, only when a respective switch 65, 65' or 65" is closed. Thus, in the example of FIG. 1, since only one of these switches will be closed at one time, only one of the trigger circuits 57, 57' or 57" will emit a pulse at the power supply zero crossing. When such a pulse is emitted, the respective SCR 51, 51' or 51" will remain in a conductive state until the next zero crossing. Looking at the network 37, for example, the pulsing of the SCR 51 at the beginning of each half cycle causes a full wave triggering signal to be applied to the terminal 31 of the thyristor 25, if the switch 67 is closed. This provides full power to the lamp 19 for daytime operation. When the switch 67 is open, however, the diode network 37 applies a half-wave rectified current to the terminal 31 in the form of that shown in FIG. 2C. The result is that the output of the thyristor 25 at the terminal 13 is also a half-wave voltage in the form of FIG. 2C, thereby providing reduced power operation of the lamp 19 during the night time. The thyristor 25 is such that it will not conduct a given half cycle unless there is a triggering current provided to its control terminal 31. This triggering current is provided each half cycle when the switch 67 is closed but when that switch is open the triggering current occurs only every other half cycle and thus the thyristor output occurs only every half cycle as well.

The diode networks 39 and 41 operate similarly except that their dimming switches 69 and 71 are positioned in a different leg of the diode network than in the network 37. The result is that when the switches 69 and 71 are opened, the respective outputs of the thyristor 27 and 29 occur on every other half cycle, as shown in FIG. 2D, that is out of phase with the output of the thyristor 25 of FIG. 2C. When the switches 69 and 71 are closed, their respective thyristors 27 and 29 operate with a full wave current output to the lamps being driven.

Figure 3:
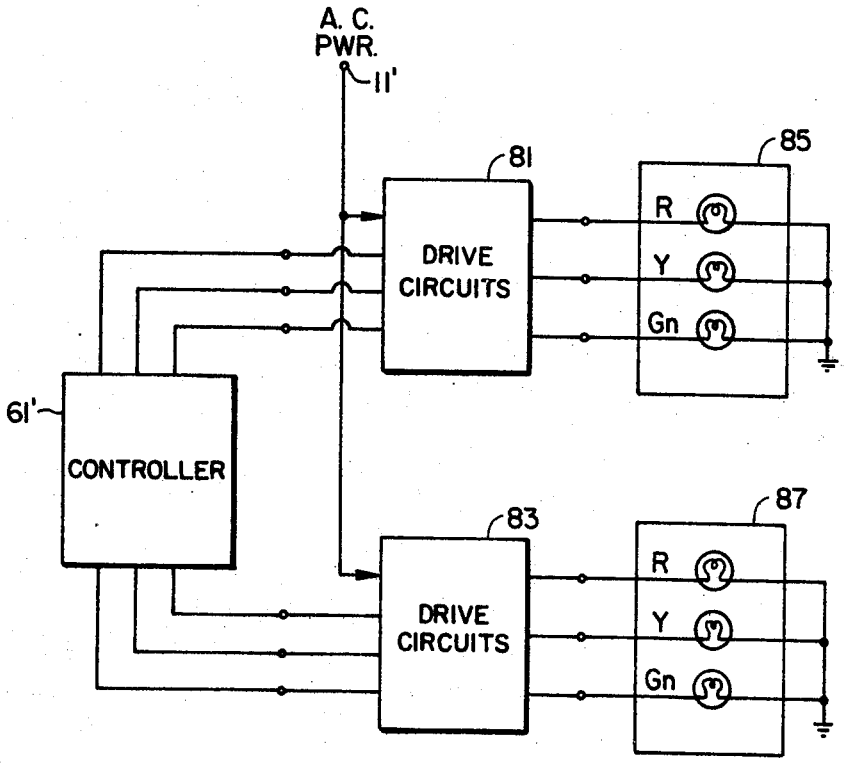
FIG. 3 illustrates in block diagram form a simple intersection traffic light installation utilizing the driving circuits of FIG. 1.

The placement of the switches 69 and 71 in an opposite leg of their respective diode network than the placement of the switch 67 has the advantage of significantly reduced power consumption and power cost of a traffic signal installation when two or more controllers of FIG. 1 are utilized. This can be understood by reference to FIG. 3 where a simple intersection traffic control system is outlined in block diagram form. Circuit blocks 81 and 83 each contain the complete circuit outlined in FIG. 1 to drive, respectively, a traffic light array 85 in one direction of the intersection, and an array 87 for the other. A controller 61' operates the switches which cause the appropriate traffic signal lights to be turned on and off by the circuit of FIG. 1. Each of the circuits 81 and 83 is fed by a common power supply terminal 11. In the example of a simple two-way crossing, the controller 61' will cause the red light of either of the arrays 85 or 87 to be lighted at the same time that a yellow light or green light of the other array is lighted. Thus, it can be seen that the lighted light of one of the arrays 85 and 87 will, when the circuits 81 and 83 are in their dimmed mode, draw half-wave rectified current in the form of FIG. 2C while the other will draw current in the form of FIG. 2D. The result is that the entire installation is viewed from the AC power terminal 11 as energizing only a single light, as can be seen by combining the waveforms of FIGS. 2C and 2D. In the bright mode operation of the signal lights, of course, each light will draw full wave power and will appear at the power terminal 11 to be two incandescent lights operating in parallel.

In summary, the circuit of FIG. 1 operates to drive one of the thyristors to its conductive states by pulsing it at the beginning of each half cycle for full brightness operation or every other half cycle for dimmed operation. This pulsing is initiated by the trigger pulses applied to the gate of the silicon controlled rectifier 51, 51' or 51".

Although the various aspects of the present invention have been described with respect to their preferred embodiments, it will be understood that the invention is entitled to protection within the full scope of the appended claims.

I claim:

1. A traffic light switching circuit for connecting to an alternating current power source at least one conductor to which a traffic light is connected for energization in response to an input control signal, comprising:

a three-terminal switching device connected to provide an electrical connection between said conductor and said alternating current source through two terminals of said switching device in response to a control signal applied to a third terminal thereof, said three-terminal switching device being characterized by conducting between its said two terminals after an appropriate control signal is applied to its control terminal and continuing to conduct until the current therethrough goes to zero at which time the switching device ceases to conduct until another appropriate signal is applied to its control terminal, and said control signal generating means including a full wave rectifier connected for one leg to be disabled in response to one state of said external signal, whereby such disablement causes said switching device to conduct for only one-half of each cycle of said alternating current power source, and means connected to said alternating current power source and responsive to an external signal for generating said control signal in a manner to apply either a full wave alternating current signal to said control terminal or a half-wave signal thereto depending upon the state of said external signal, whereby a light connected to said at least one conductor may be operated at one of two brightness levels depending upon the state of said external signal.

2. A traffic light switching circuit for independently connecting to an alternating current power source at least one conductor for each of red, yellow and green traffic lights, comprising a three-terminal switching device associated with each of said red, yellow and green at least one conductors to provide an electrical connection between the conductor and said alternating current source through two terminals thereof in response to a control signal applied to a third terminal thereof, whereby each of said red, yellow and green lights may be independently turned on and off by applying an appropriate control signal to the control terminal of their associated switching device, each of said three terminal switching devices having associated therewith means connected to said alternating current power source and responsive to an external signal for controllably generating said control signal in a manner to apply either a full wave signal to said control terminal or a half-wave signal thereto depending upon the state of said external signal, the half-wave signal applied to the three terminal switching device control terminal for the red light by its control signal generating means occurring for the duration of either the positive or negative one-half cycle of said alternating current power source and the half-wave signal applied to the three terminal switching devices for the yellow and green lights by their respective control signal generating means occurring during the positive or negative one-half cycle of said alternating current power source opposite to the half cycle operation of the control signal generating means associated with the red traffic light, whereby a pair of red, green and yellow traffic lights can be driven from a common alternating current power source in their half-wave operation and appears to the alternating current power source to be substantially the same as if a single set of red, yellow and green traffic lights were driven with full wave power.

* * * * *